US007650247B2

(12) United States Patent
Leveque

(10) Patent No.: US 7,650,247 B2
(45) Date of Patent: Jan. 19, 2010

(54) METHOD FOR THE ELECTRICAL PROTECTION OF AN ELECTRICAL HOUSEHOLD APPLIANCE

(75) Inventor: Patrick Leveque, Vire (FR)

(73) Assignee: Seb S.A., Ecully (FR)

( * ) Notice: Subject to any disclaimer, the term of this patent is extended or adjusted under 35 U.S.C. 154(b) by 382 days.

(21) Appl. No.: 11/574,291

(22) PCT Filed: Aug. 31, 2005

(86) PCT No.: PCT/FR2005/050695

§ 371 (c)(1),
(2), (4) Date: Feb. 26, 2007

(87) PCT Pub. No.: WO2006/035171

PCT Pub. Date: Apr. 6, 2006

(65) Prior Publication Data

US 2008/0092750 A1 Apr. 24, 2008

(30) Foreign Application Priority Data

Sep. 30, 2004 (FR) ..... 04 52212

(51) Int. Cl.
*F04B 49/06* (2006.01)
*A47J 27/62* (2006.01)

(52) U.S. Cl. ..... 702/64; 702/60; 702/61; 702/65; 318/62; 318/103; 318/453; 318/782; 417/53; 99/333

(58) Field of Classification Search ..... 702/64, 702/60, 61, 65; 99/333; 318/62, 103, 453, 318/782; 417/53
See application file for complete search history.

(56) References Cited

U.S. PATENT DOCUMENTS

| | | | | |
|---|---|---|---|---|
| 3,537,384 | A | 11/1970 | Stauber | |
| 3,953,777 | A * | 4/1976 | McKee | 318/474 |
| 2002/0093306 | A1 | 7/2002 | Johnson et al. | |

FOREIGN PATENT DOCUMENTS

| | | |
|---|---|---|
| DE | 195 34 464 | 12/1996 |
| EP | 0 687 436 | 12/1995 |
| EP | 0687436 | * 12/1995 |

* cited by examiner

*Primary Examiner*—Sujoy K Kundu
(74) *Attorney, Agent, or Firm*—Jeff Rothenberg; Heslin Rothenberg Farley & Mesiti P.C.

(57) ABSTRACT

A method is provided for the electrical protection of an electrical household appliance that is used to prepare food. The appliance includes an electric pump which is supplied with alternating current in order to convey a liquid through a conduit, and a heating element to raise the temperature of the liquid. The instantaneous value of the current I supplied to the pump is measured at regular time intervals. The method includes calculating the average value $\alpha_n$ of m current I measurements taken over a pre-determined time period T; comparing the average value $\alpha_n$ with a reference value $\alpha_{ref}$ calculated as the average value of the current I measurements taken over an earlier period of the same length; and opening the pump's power supply circuit when the difference between the average values $\alpha_{ref}$ and $\alpha_n$ exceeds a pre-determined threshold value $\Delta_1$ for at least two successive time periods T as a result of low average current indicative of dry running.

8 Claims, 2 Drawing Sheets

METHOD FOR THE ELECTRICAL PROTECTION OF AN ELECTRICAL HOUSEHOLD APPLIANCE

CROSS REFERENCE TO RELATED APPLICATIONS

This application is a 371 filing of international application PCT/FR2005/050695, filed Aug. 31, 2005 and published in French as international publication WO 2006/035171 on Apr. 6, 2006, and claims priority of French Application No. 0452212 filed on Sep. 30, 2004, which applications are hereby incorporated by reference herein, in their entirety.

FIELD OF THE INVENTION

The invention relates to the field of electrical household appliances and, more precisely, appliances that are used to prepare food comprising a water compartment and a pump for circulating this water. It relates more especially to coffee makers equipped with a piston pump and espresso-type coffee makers in particular.

It relates more especially to a method for detecting dry running of the pump and controlling opening of its supply circuit in order to prevent rapid damage to the pump.

DESCRIPTION OF THE PRIOR ART

Generally speaking, there are numerous solutions for detecting that the water compartment of an espresso or low-pressure type coffee maker is empty. In particular, the use of floats which, when the level in the compartment is empty, are located at their lowest level and thus indicate lack of water in the compartment is well known. The power supply of the pump is then switched off.

However, deposited limescale and natural wear of the mechanism make this solution relatively unreliable because, firstly, the float frequently remains stuck in its upper position and, secondly, the sensor that it triggers when it reaches its low position may be faulty.

It is also common to detect dry running of a pump by means of flowmeters installed on the water supply pipe to the pump. This type of solution is relatively effective. Nevertheless, the cost of such flowmeters increases the cost price of such appliances.

Many solutions in which the supply current of a pump is measured in order to detect dry running of a pump are also known.

In fact, as described in Document U.S. Pat. No. 6,534,947, measuring the supply current and supply voltage of a pump makes it possible to calculate the phase difference between these two signals. It has been observed that when the load of the pump diminishes, the phase difference between these two signals increases. Thus, when the measured phase difference exceeds a pre-determined threshold value stored in a microcontroller, it is possible to automatically control opening of the pump supply circuit.

Nevertheless, such a system requires numerous measuring instruments because it is necessary to measure both the current and voltage supplied to the pump of the appliance.

The Applicant has described a protective method in Document FR 03.06143 which is unpublished at the time of the present application. According to this method, one measures a time difference over one alternation of the pump's supply current. This measurement is made between the instant when the current is at its maximum and the instant when it cancels itself out. This time difference is then compared with the theoretical time difference of the current when the pump is operating at normal load. If this difference exceeds a preset threshold value stored in a microcontroller, the power supply to the pump is switched off.

Such a system is relatively complex to implement and requires considerable computing power in order to determine the maximum peak of the pump's supply current. Thus, such a system is not really suitable for coffee makers because they do not have any sophisticated electronics.

The object of the invention is to deliver a reliable, effective and inexpensive solution in order to detect dry running of a pump in a coffee maker and automatically switch off the pump's power supply.

SUMMARY OF THE INVENTION

The invention therefore relates to a method for the electrical protection of an electrical household appliance that is used to prepare food. The latter comprises an electric pump which is supplied with alternating current and a heating element in order to raise the temperature of a liquid transported in a pipe by the pump. This method comprises measuring the instantaneous value of the current I supplied to the pump at regular time intervals;

This method is characterised in that:

- one calculates the average value $\alpha_n$ of m measurements of current I taken over a pre-determined time period T;
- one compares this average value $\alpha_n$ with a reference value $\alpha_{ref}$ calculated as the average value of m current I measurements taken over an earlier period of the same length;
- one controls opening of the pump's power supply circuit when the difference between the average values $\alpha_{ref}$ and $\alpha_n$ exceeds a pre-determined threshold value $\Delta_1$ for at least two consecutive time periods T.

In other words, measurements of current I are taken at regular time intervals and one calculates their average value an over a pre-determined time period T. One then calculates the difference between $\alpha_n$ and a reference value $\alpha_{ref}$ calculated in the same way as before.

The pump is powered as long as the value of this difference is less than the value of threshold $\Delta_1$. As soon as this difference exceeds the threshold for at least two successive time periods T, the pump's power supply circuit is opened.

In one embodiment, each time the appliance is switched on and in order to prevent the pump running dry if the water compartment of the coffee maker is already empty,

- one measures temperature $\theta_1$ of the heating element at instant $t_1$ when the pump is switched on;
- after a pre-determined time period, one measures temperature $\theta_2$ of the heating element at instant $t_2$;
- one compares temperatures $\theta_1$ and $\theta_2$ of the heating element between these two instants;
- one controls opening of the pump's power supply circuit if the difference between the two values $\theta_1$ and $\theta_2$ is less than a second pre-determined threshold value $\Delta_2$.

In other words, on powering up, one monitors changes in the temperature of the heating element in addition to monitoring the current in the pump.

When the heating element reaches a pre-determined temperature or when a pre-determined period has elapsed, one then powers the pump. If, after a certain time, the temperature of the heating element has not dropped by at least a pre-determined value compared with the temperature initially measured, one deduces that there is no water in the system.

In fact, when there is water in the pipe, the flow of water in contact with the heating element causes the latter's temperature to drop very quickly and this provides a reliable way of detecting the presence of water in the water compartment at the start of the cycle.

In practice, time period T may correspond to one alternation of the pump's alternating supply current. Thus, with each alternation, one makes m measurements of pump supply current I.

According to one embodiment, one can control opening of the pump supply circuit when the difference between the average values $\alpha_n$ and $\alpha_{ref}$ exceeds a pre-determined threshold value $\Delta_1$ for five successive alternations.

In fact, one can assume that, at a 50 Hz mains frequency (or even 60 Hz in the United States), five successive alternations are sufficient to make sure that the water compartment is empty.

Advantageously, reference value $\alpha_{ref}$ can be the average value $\alpha_1$ of the measurements of current I evaluated after the first alternation after switching on the appliance. In this case, the first average value $\alpha_1$ that is calculated is stored and compared with average values $\alpha_n$ measured during subsequent periods.

According to one particular embodiment of the invention, reference value $\alpha_{ref}$ can be modified gradually in step with changes in the instantaneous average value $\alpha_n$. In this way, one adapts reference value $\alpha_{ref}$ if it decreases continuously and slowly.

In practice, comparisons between, firstly, average values $\alpha_n$ and $\alpha_{ref}$ and, secondly, temperatures $\theta_1$ and $\theta_2$ can be obtained by using a microcontroller in which pre-determined threshold values $\Delta_1$ and $\Delta_2$ are stored.

The microcontroller thus performs simple operations that do not require significant computing power. The two threshold values can be modified very simply so as to allow this method to be incorporated in any type of coffee maker.

The microcontroller can control opening of the pump's power supply circuit. In other words, the microcontroller is used both as an arithmetic unit and as a control unit for controlling the power supply of the pump and the heating element.

BRIEF DESCRIPTION OF THE DRAWINGS

The way in which the invention is implemented and its resulting advantages will be readily apparent from the description of the following embodiment, given merely by way of example, reference being made to the accompanying drawings in which.

DESCRIPTION OF THE PREFERRED EMBODIMENTS

As stated above, the invention relates to a method for the electrical protection of an electrical household appliance that is used to prepare food.

Figure 1:
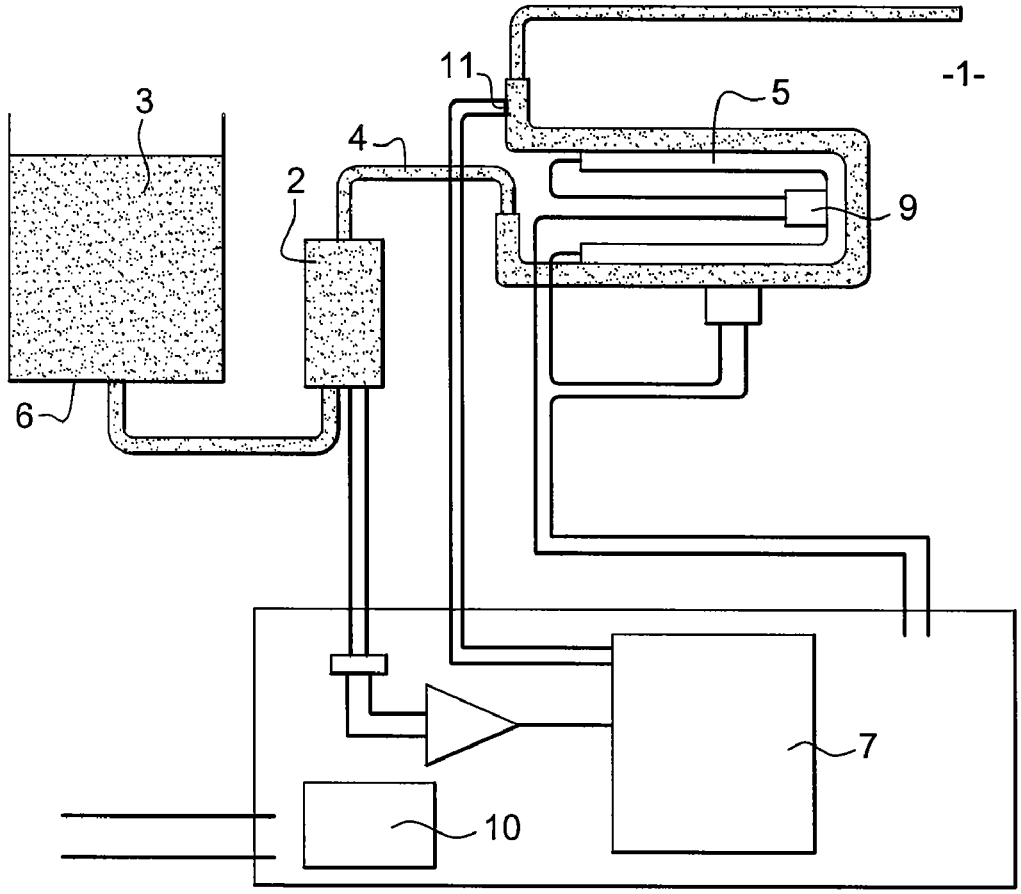
FIG. 1 is a schematic view of a coffee maker supply and protection system in accordance with the invention.

As shown in FIG. 1, appliance (1) comprises a pump (2) used to transport water (3) from a water compartment (6) into conduit (4). Conduit (4) then comes in contact with heating element (5) which is used to raise its temperature and allows it to be used to make coffee in particular.

A power supply circuit (10) is connected to the mains supply and distributes power to the various electric load devices of electrical household appliance (1).

A microcontroller (7) fitted in this circuit receives various signals. In fact, via a comparator and a shunt, microcontroller (7) receives the instantaneous value of the supply current flowing through pump (2) at regular time intervals.

In addition, a Negative Temperature Coefficient (NTC) thermistor (11) is fitted on conduit (4) and sends a signal representative of the temperature of the water in conduit (4) to the microcontroller and is thus downstream from heating element (5) with which it is in contact. This thermistor (11) thus makes it possible to adjust the supply of heating element (5) so that the water remains at a substantially constant temperature.

A thermal fuse (9) provides the system with an additional safety component because it makes it possible to open the supply circuit of heating element (5) when the latter's temperature exceeds a threshold value.

Figure 2:
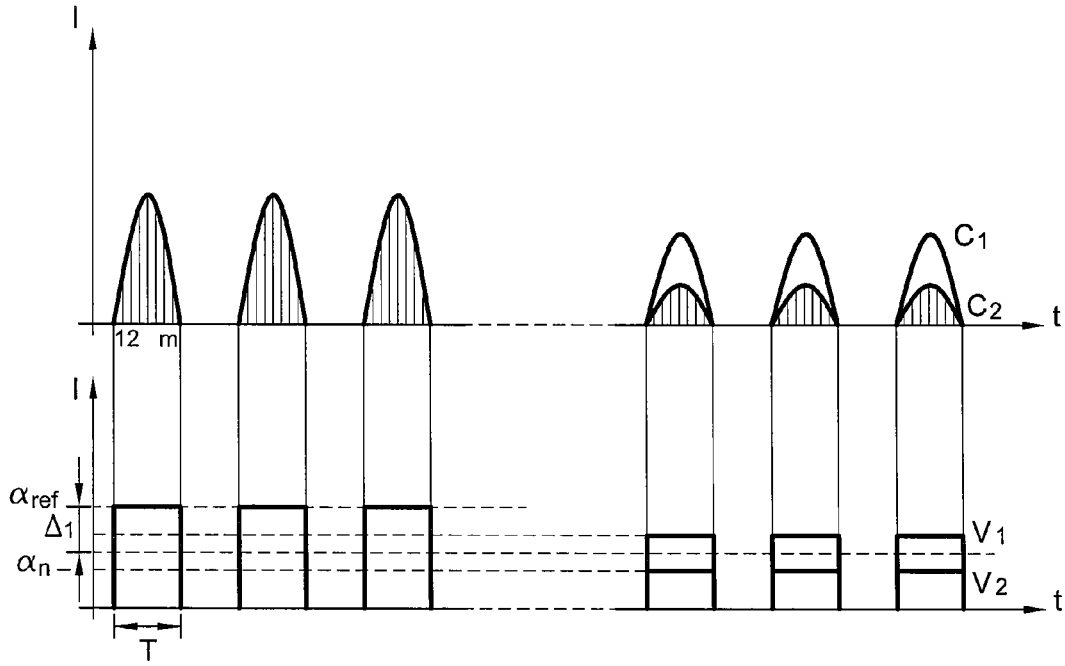
FIG. 2 is a timing diagram showing two possible changes in pump supply current I and its average value in accordance with the invention.

As shown in FIG. 2, one measures the instantaneous value of current I m times over time period T, then one calculates the associated average value $\alpha_n$.

Two possible changes in the curve of current I are represented so as to illustrate different assumptions.

Curve $C_1$ represents a water compartment that still contains water because the supply current of pump (2) has not yet dropped significantly. Curve $V_1$ associated with it represents the average values $\alpha_n$ of each half cycle of current I over time period T.

In contrast, curve $C_2$ represents dry running of pump (2). Similarly, curve $V_2$ represents the average values an of each half cycle of current I over time period T.

In this second case, the difference between $\alpha_{ref}$ and $\alpha_n$ exceeds threshold value $\Delta_1$. In addition, this overshoot occurs during three successive alternations and this makes it possible to deduce that the compartment is empty. One then controls opening of the power supply circuit of pump (2). Heating element (5) remains set to its set point temperature.

In order to detect dry running of the pump, microcontroller (7) compares the average values $\alpha_n$ of current I with the first value $\alpha_1$ measured at the start of the cycle. A pre-determined threshold value $\Delta_1$ stored in microcontroller (7) is then used to detect dry running of pump (2) and open its power supply circuit in order to prevent damage to it.

Figure 3:
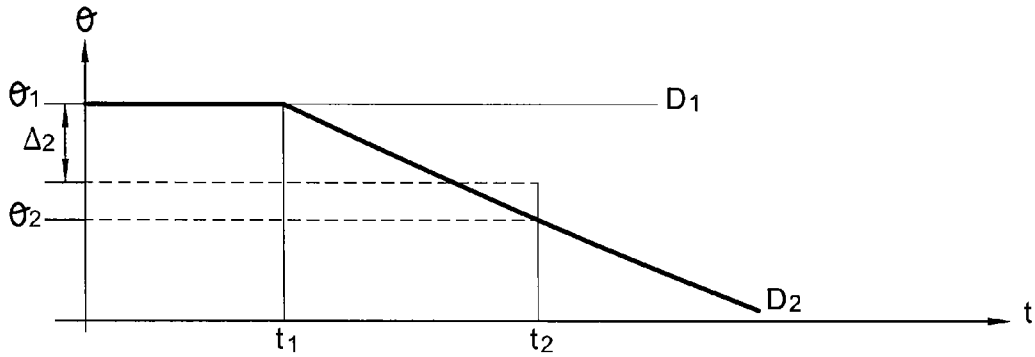
FIG. 3 is a timing diagram showing two possible changes in temperature θ of the heating element in accordance with the invention.

FIG. 3 represents two different curves showing possible changes in temperature θ sensed by thermistor (11) and corresponding to the temperature of conduit (4) right on the outlet of heating element (5) just after pump (2) is switched on. At instant $t_1$ pump (2) is powered and one measures temperature $\theta_1$ of heating element (5).

Note that, at instant $t_2$, only curve $D_2$ has a temperature $\theta_2$ having a difference compared with $\theta_1$ in excess of pre-determined threshold value $\Delta_2$ which is also stored in microcontroller (7).

Thus, curve $D_1$ represents a compartment that is empty from the start of the cycle when pump (2) is switched on because there is no change in temperature due to lack of incoming water. The supply to pump (2) is switched off and an audible or visible alert informs the user that they must put water into the compartment, heating element (5) remains set to its set point temperature.

Subsequently, only curve $D_2$ represents the presence of water in the compartment from the start of the cycle. In fact, conduit (4) near heating element (5) is initially empty and at an initial temperature $\theta_1$ (e.g. 120° C.) is temporarily cooled by the first inflow of water to a temperature that is substantially lower (e.g. 95° C.). Subsequently, the temperature of conduit (4) rises back up to its operating temperature (e.g. 100° C.) thanks to this adjustment.

The above description demonstrates that the method of protection in accordance with the invention has many advantages, in particular:

it provides a relatively inexpensive safety system;

it can very easily be adapted to any type of electrical household appliance used to prepare food and equipped with a pump;

it is very reliable and effective in use.

The invention claimed is:

1. A method for electrical protection of an electrical household appliance that is used to prepare food, the appliance comprising an electric pump which is supplied with alternating current by a power supply circuit in order to convey a liquid through a conduit, and a heating element to raise temperature of said liquid, said method comprising:

measuring instantaneous value of current I supplied to the pump at regular time intervals;

calculating an average value $\alpha_n$ of m measurements of current I taken over a pre-determined time period T;

comparing the average value $\alpha_n$ with a reference value $\alpha_{ref}$ calculated as an average value of measurements of current I taken over an earlier period of same length as time period T; and controlled opening of the power supply circuit to automatically switch off power to the pump when a difference between the reference value $\alpha_{ref}$ and the average value $\alpha_n$ exceeds a pre-determined threshold value $\Delta_1$ for at least two successive time periods T as a result of low average current supplied to the pump indicative of dry running.

2. A method as claimed in claim 1, further comprising, every time the appliance is switched on, measuring temperature $\theta_1$ of the heating element at instant $t_1$ when the pump is switched on;

after a pre-determined time period, measuring temperature $\theta_2$ of the heating element at instant $t_2$;

comparing temperatures $\theta_1$ and $\theta_2$ of the heating element; and controlled opening of the power supply circuit to automatically switch off power to the pump when a difference between the two temperatures $\theta_1$ and $\theta_2$ is less than a second pre-determined threshold value $\Delta_2$, whereby, in addition to monitoring current supplied to the pump, changes in temperature of the heating element are monitored for electrical protection of the appliance when the appliance is switched on.

3. A method as claimed in claim 1, wherein time period T corresponds to one alternation of the alternating supply current of the pump.

4. A method as claimed in claim 3, wherein controlled opening of the power supply circuit occurs when the difference between the average value $\alpha_n$ and the reference value $\alpha_{ref}$ exceeds a pre-determined threshold value $\Delta_1$ for five successive alternations of the alternating supply current.

5. A method as claimed in claim 1, wherein reference value $\alpha_{ref}$ is an average value $\alpha_1$ of the measurements of current I over a first alternation of the alternating supply current after switching on the appliance.

6. A method as claimed in claim 1, wherein reference value $\alpha_{ref}$ is modified gradually in step with changes in instantaneous average value $\alpha_n$.

7. A method as claimed in claim 2, wherein the appliance further includes a microcontroller, and the pre-determined threshold values $\Delta_1$ and $\Delta_2$ are stored in the microcontroller, and the steps of comparing, firstly the average value $\alpha_n$ and the reference value $\alpha_{ref}$ and, secondly, temperatures $\theta_1$ and $\theta_2$ are performed by the microcontroller.

8. A method as claimed in claim 7, wherein the microcontroller controls opening of the power supply circuit based on results of the steps of comparing.

* * * * *